United States Patent [19]

van der Kooij

[11] 4,018,122

[45] Apr. 19, 1977

[54] ELECTRONIC MUSICAL INSTRUMENT WITH AUTOMATIC BASS ACCOMPANIMENT

[75] Inventor: Tijmen van der Kooij, Bodegrave, Netherlands

[73] Assignee: B.V. "Eminent" Fabriek van Electronische Orgels, Bodegraven, Netherlands

[22] Filed: Aug. 14, 1975

[21] Appl. No.: 604,827

Related U.S. Application Data

[63] Continuation-in-part of Ser. No. 443,375, Feb. 19, 1974, abandoned.

[52] U.S. Cl. ..... 84/1.03; 84/1.01; 84/1.17

[51] Int. Cl.² ..... G10F 1/00

[58] Field of Search ..... 84/1.01, 1.03, 1.17, 84/DIG. 12, DIG. 22

[56] References Cited

UNITED STATES PATENTS

| | | | |
|---|---|---|---|
| 3,526,700 | 9/1970 | Ruppert | 84/DIG. 22 X |
| 3,546,355 | 12/1970 | Maynard | 84/1.03 |
| 3,548,066 | 12/1970 | Freeman | 84/1.03 |
| 3,688,010 | 8/1972 | Freeman | 84/1.11 |
| 3,795,755 | 3/1974 | Uchiyama | 84/1.03 |

*Primary Examiner*—Ulysses Weldon
*Attorney, Agent, or Firm*—Kurt Kelman

[57] ABSTRACT

Twelve flip-flops each corresponding to one of the twelve keys within an octave are provided. Each is set by depression of one corresponding key in the accompaniment manual or simultaneous depression of more than one key in the manual for playing the melody. All flip-flops are reset upon depression of a subsequent key. The q output of each flip-flop is connected to a corresponding input of reduction circuits which reduce all possible combinations of the input signals to 32 five bit words signifying 31 chords and an O signal. The 32 words are applied to tone control means which also receives signals from a bass program selector. The tone control means produces rhythmically the codes of the appropriate bass tones. Three of the five output lines of the tone control means are applied to a 3 to 6 decoder which has six output lines, a signal on each of the lines gating a corresponding tone signal to the input of a frequency reduction stage which divides the frequency of the tone signal in accordance with other outputs of the tone control means. The output of the frequency divider stage is applied to the sound reproduction system.

20 Claims, 8 Drawing Figures

ELECTRONIC MUSICAL INSTRUMENT WITH AUTOMATIC BASS ACCOMPANIMENT

This is a continuation-in-part of my copending application Ser. No. 443,375, filed Feb. 19, 1974 now abandoned.

The invention relates to an electronic musical instrument such as an electronic organ having keys which are arranged in one or more manuals and comprising an automatic bass accompaniment system, means for activating said bass accompaniment system by an electric input signal in response to a depression of one or more keys, a rhythm generator and a bass program generator.

It is important that electronic musical instruments be so easy to play that a lack of proficiency of the player has but little influence on the results of his play. A disadvantage of previous measures for the simplification of the play is that they generally result in a decrease of the possible outputs of the instrument and that the player must be content with musically defective solutions. With known embodiments of instruments having an automatic bass accompaniment a single key touched in any octave determines the mode in which the automatic accompaniment play is carried out. Simultaneously touching, or at least almost simultaneously touching, a further key has no consequence because in some way or other a hierarchy has been imposed on the electric key signals, i.e. the voltages being generated while touching keys. Connected therewith is the fact that only one single relation of tones, mostly the major third mode, is available for the bass program.

It is further usual that an electronic musical instrument, such as an electronic organ, has an upper manual, a lower manual and pedal keys. Generally the melody is produced by playing the upper manual, whereas playing of the lower manual is meant for the accompaniment with chords. In such known systems, an automatically working accompaniment system is activated from the accompaniment manual. Specifically, a chord impressed on the lower manual for accompaniment is rhythmically modulated to imitate a guitar, banjo, or piano accompaniment under control of the rhythm program generator. A bass selection system, such as has been described for instance in the German Offenlegungsschrift 2 053 245, is also considered as an automatic accompaniment system with respect to the present invention.

In the usual embodiment, the dependency of the functioning of the accompaniment system on the type of play, staccato or legato, in the accompaniment manual can be considered as a shortcoming. Another shortcoming of conventional systems is that activation of the accompaniment system from the upper manual intended for playing a melody can result in an incorrect sound output and such activation should therefore be suppressed.

The invention has as its object to extend the possibilities of the bass accompaniment system in a simple way.

A further object of the invention is elimination of the above-described shortcomings.

According to the invention the possibilities of the bass accompaniment system are extended in that means are present for reducing the $2^{12}-1$ different electric input signals and combination of signals caused by the depression of keys, to 31 different fundamental tone signals and fundamental chord signals respectively each selecting another musically acceptable combination of bass tones for the automatic bass accompaniment system.

The bass accompaniment system is made independent of the type of play, staccato or legato, by providing memory means in association with the keys. Specifically, each memory element is set by the depression of one corresponding key in the accompaniment manual or the simultaneous depression of two or more keys in the melody manual. All memory means are reset in response to the depression of a sebsequent key, the reset of the operation immediately preceeding the set operation in the memory means associated with the depressed key.

In a preferred embodiment of the present invention, the number of memory means is equal to the number of keys in one octave. The same-named keys of the other octaves are connected in parallel with corresponding key in the selected octave. This limiting of the automatic accompaniment play to a favorably selected octave yields very acceptable musical results.

The reducing means are advantageously adapted to process the key signals digitally.

In particular, the invention provides an embodiment in which the 31 fundamental tone signals, or fundamental chord signals, relate to 12 major modes, 12 minor modes, four different augmented triads and three diminished chords of the seventh.

The musical instrument according to the invention has the advantage that the player is free to choose other relations than exactly the one which has been recorded in the instrument, as was usual up to now.

It will be clear that the invention provides the possibility to make the manual for playing the melody and the manual for the accompaniment completely or partly coincide without causing a sound confusion thereby. This offers the advantage that both melody and accompaniment can be taken care of with one hand. For an embodiment of the present invention in which only one manual is used, each memory means is responsive to the simultaneous activation of two or more keys only.

The invention will be described with reference to the drawing in which.

Figure 3:
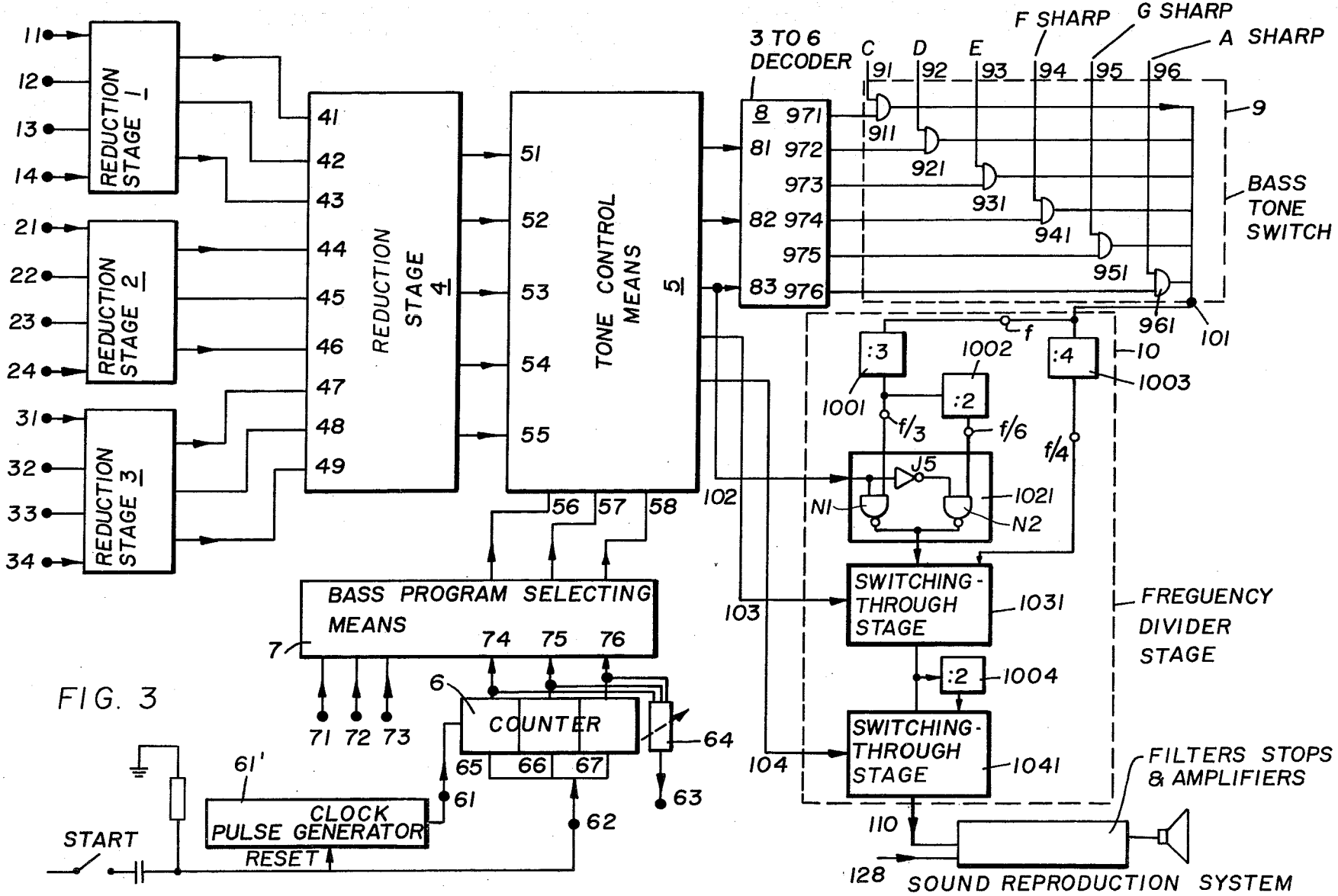
FIG. 3 is a block diagram of the bass accompaniment system in accordance with the present invention.
Figure 4:
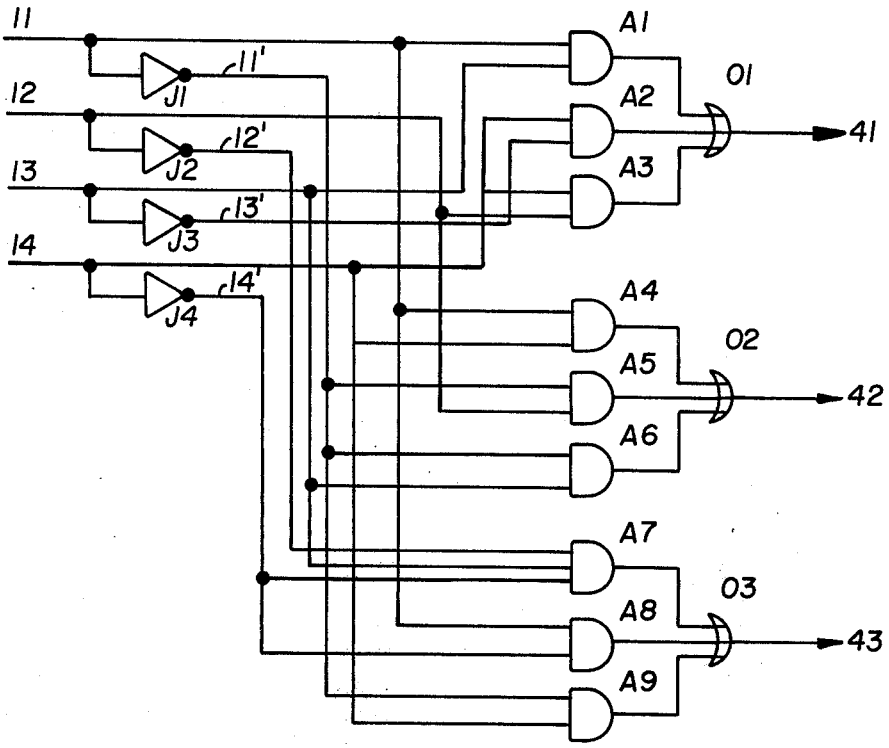
FIG. 4 shows a preferred embodiment of signal reduction stage 1 of FIG. 3.
Figure 7:
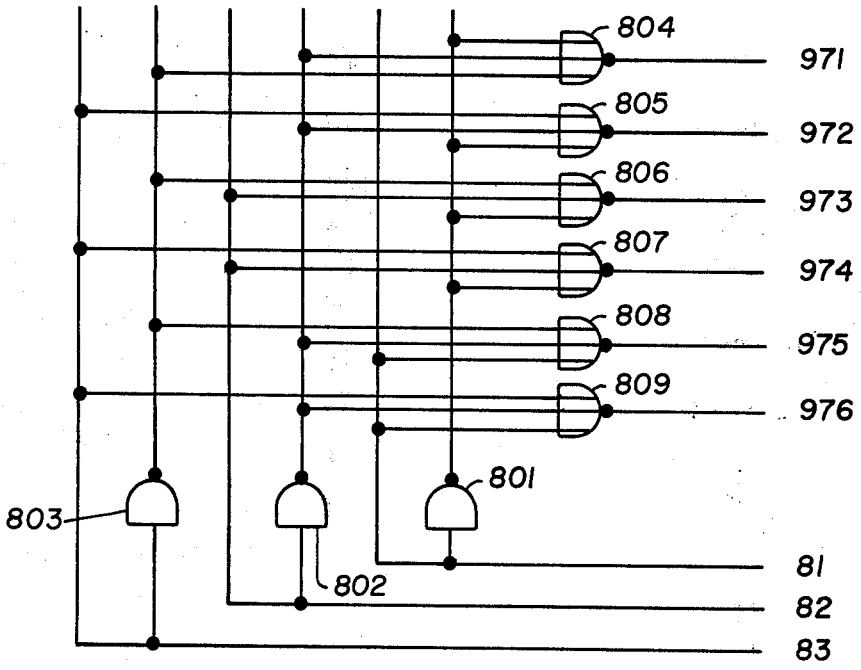
Figure 4A:
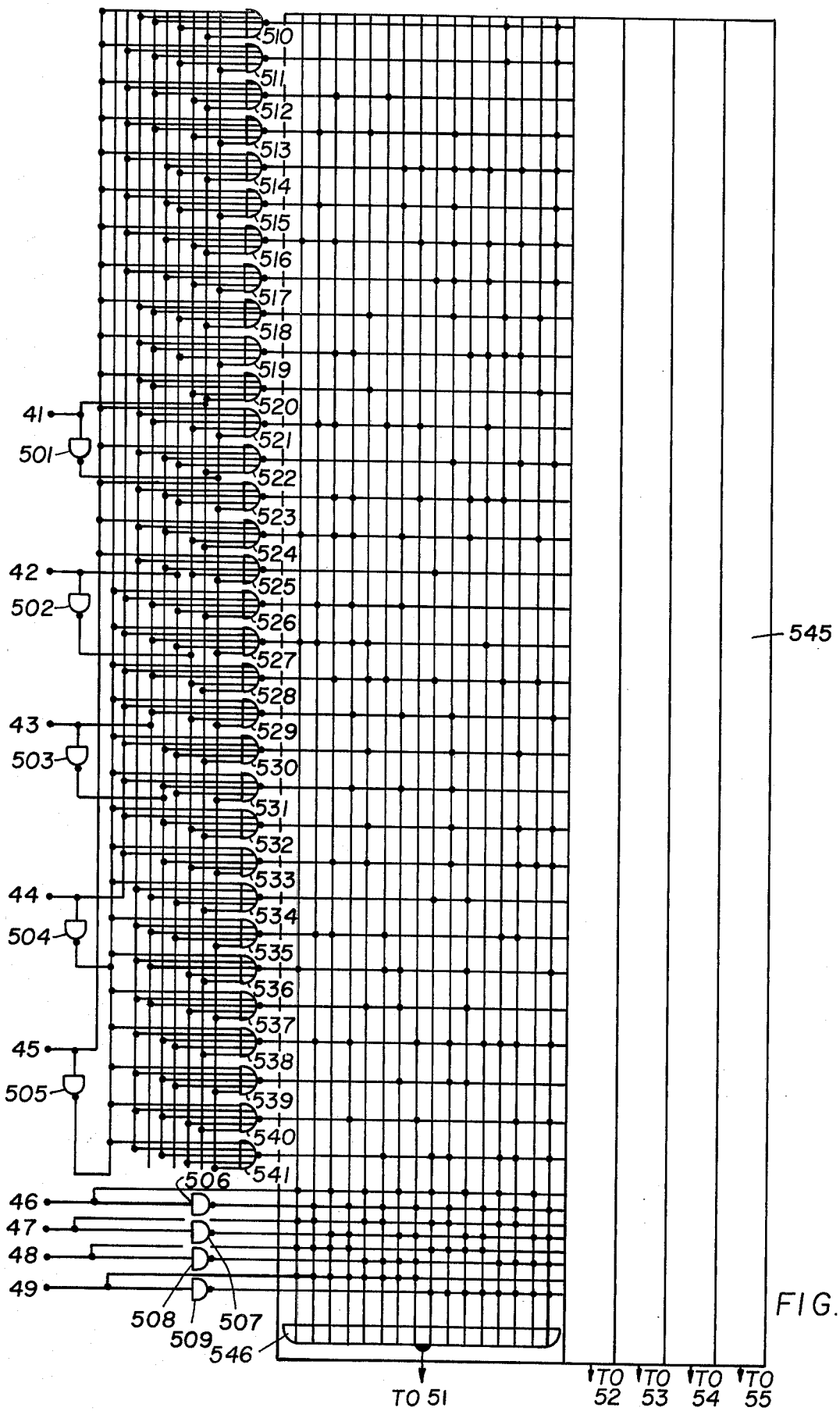
Figure 5:
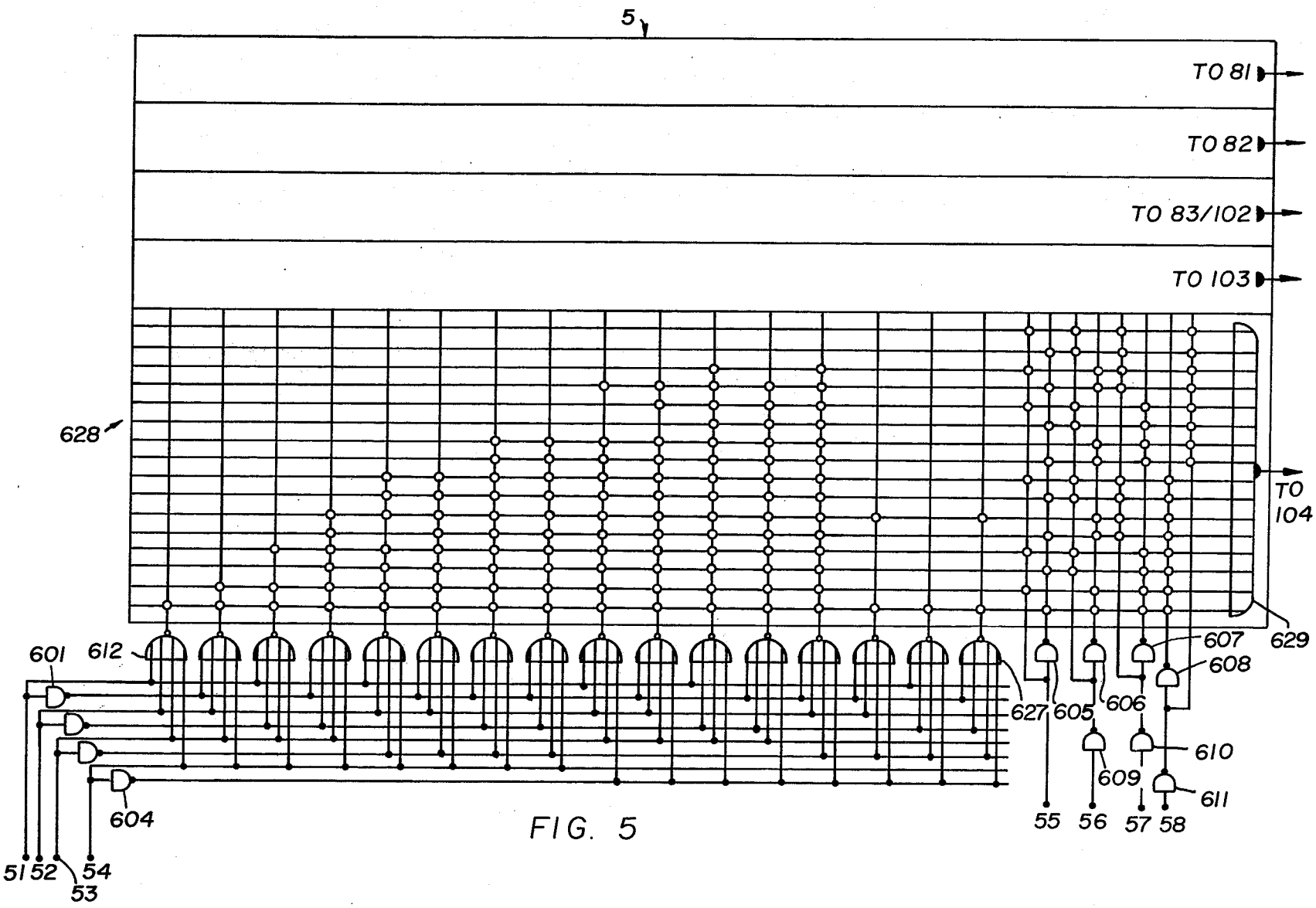
Figure 6:
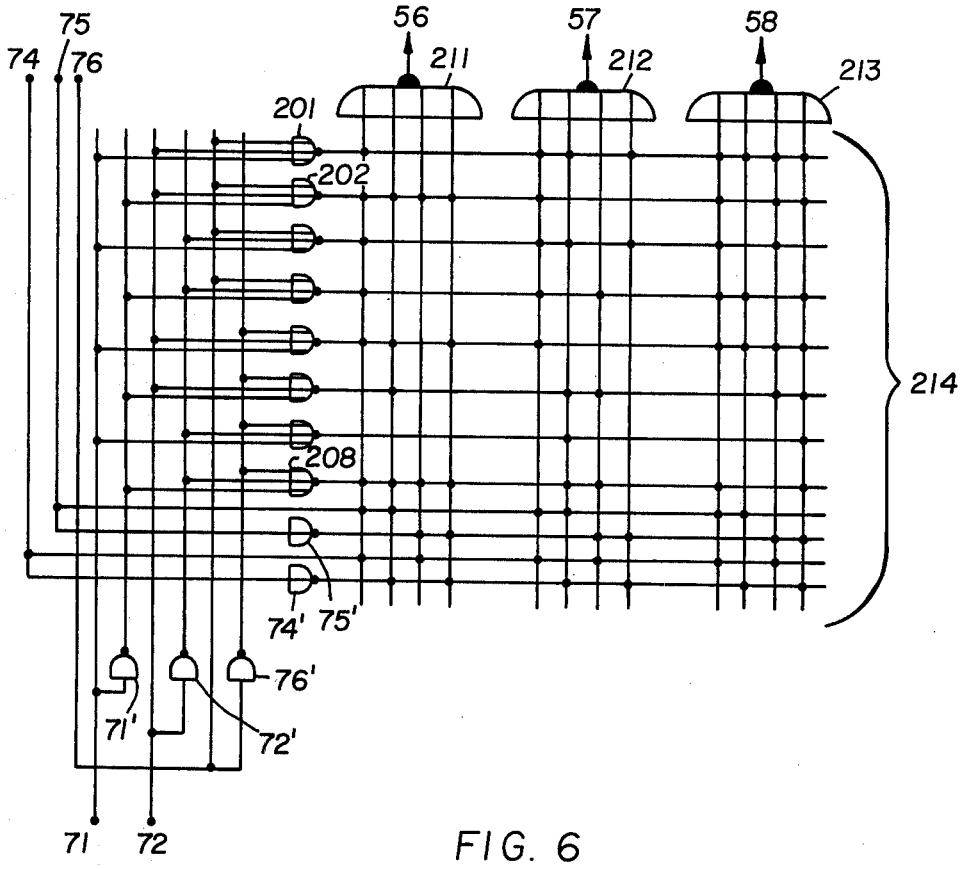

FIG. 4*a* shows a preferred embodiment of signal reduction stage 4 of FIG. 3;

FIG. 5 shows a preferred embodiment of the tone control means of FIG. 3;

FIG. 6 shows a preferred embodiment of the bass program selecting means of FIG. 3; and FIG. 7 shows a preferred embodiment of 3-to-6 decoder.

Figure 1:
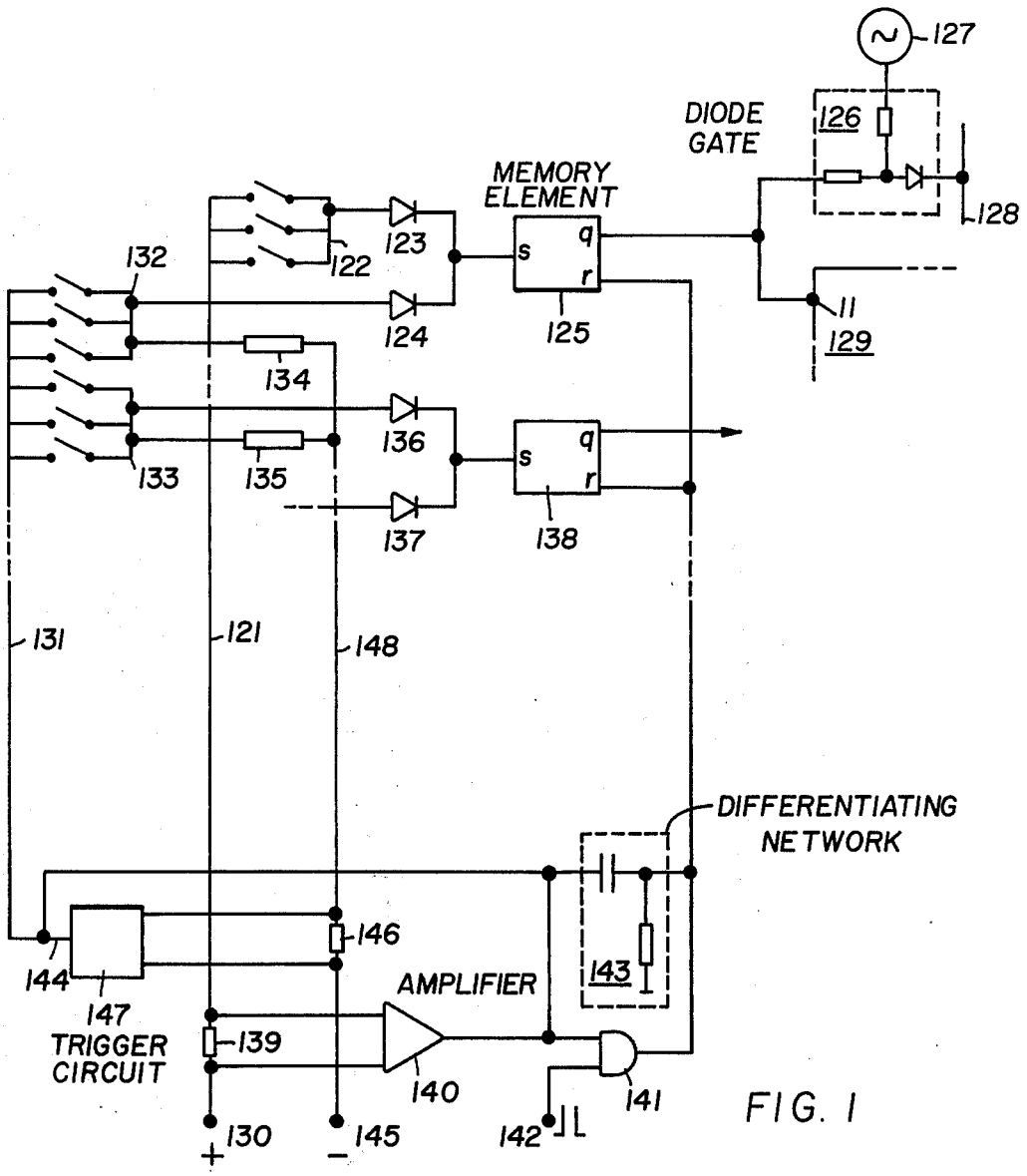
FIG. 1 is a schematic representation of the input means of the present invention and their interconnection with the remaining circuitry of the electronic musical instrument.

Referring now to FIG. 1, it is assumed that the lower or accompaniment manual has 36 keys covering three octaves. Reference number 122 refers to three of the same named keys in each of the octaves, connected in common. Thus reference number 122, in a preferred embodiment of the present invention, refers to the keys for generating tone *c*. A bus bar 121 has a positive potential. Upon touching one of the keys and thereby closing the corresponding key contact, the set input *s* of a memory element 125 is connected to the bus bar 121 via a diode 123. In a preferred embodiment of the present invention the memory element is a bistable circuit, and, more specifically, a flip-flop. When a key in the group 122 is depressed, a positive voltage level appears at the *q* output of the memory element. This voltage level on the one hand connects a tone generator 127 through a diode gate 126 to a main bus 128 from which the audio signal generated in the tone generator is used in a conventional way for imitating a guitar, a banjo, a piano and the like. On the other hand the positive voltage level is used to bring and maintain a bass accompaniment system 129 under control. The memory element 125 provides for maintaining this connection and control from the q-output even after the excitation of the set input *s* of the memory element 125 has been removed, so that staccato play does not interrupt the action of the bass accompaniment system.

To reset memory element 125, which is necessary upon depression of the subsequent key, the reset input *r* of the memory element 125 is excited from a circuit which signalizes the depression of another key. In FIG. 1 such a circuit has been represented as follows: A resistor 139 has been incorporated in the bus bar 121 immediately beyond the voltage terminal 130, the input of an amplifier 140 being connected across said resistor. The amplifier functions as a key detector. The output of the amplifier has been connected via a differentiating network 143 as well as via an AND-gate 141 to the reset input *r* of the memory element 125 and the corresponding inputs of all remaining memory elements. Depression of a key causes a voltage change across the resistor 139. This voltage change drives the amplifier 140 completely in the positive direction so that the differentiating network 143 delivers a pulse if the keys are played staccato.

A reset pulse cannot arise in this way in case of legato play. To reset the memory element suitably in this case, a second input 142 of the AND-gate 141 has been connected to the pulse generating output of a rhythm or clock pulse generator (61', FIG. 3) so that the memory element is reset each time in the rhythm given by the generator.

For the upper manual it is assumed that the set input *s* of a memory element is only to be excited if at least two differently named keys are depressed simultaneously. Again, in the preferred embodiment, 36 keys are included in the upper manual and corresponding keys in each octave are connected in common. In FIG. 1 two groups 132 and 133 of differently named keys are represented. A bus bar 131 is connected to the output 144 of a trigger circuit 147 shown in detail in FIG. 2. The input of the trigger circuit 147 is connected across a resistor 146 connected in a bus bar 148 immediately beyond a feed point 145 having a negative potential. The groups of key contacts 132 and 133 are connected to the bar 148 by resistors 134, 135, respectively. Closing a key contact in one of the groups such as 132 causes an insufficiently high current through the resistor 146 to cause the trigger circuit 147 to respond. Only also touching a key contact in the group 133 will cause a sufficiently high voltage drop across resistor 146 to activate the trigger circuit. The voltage change thereby created at the output 144 causes the excitation of the set input of the memory element 125 related to the group 132 and the memory element 138 related to the group 133 via diodes 124 and 136 respectively. The memory element 138 activates another tone generator and another input of the bass accompaniment system 129 via its *q* output. Via a diode 137 the set input of the element 138 can also be excited from a group of key contacts in the lower manual (not shown).

When playing legato, the resetting of the memory elements again takes place under control of input 142 of the AND-gate 141 because the other input of the AND-gate is then kept at a high level from the output 144 of the trigger circuit 147. During staccato play, striking once more a chord of two or more tones on the upper manual is sufficient for resetting the memory elements via the differentiating circuit 143.

The keys, diodes and flip-flop memories described above constitute the input means of the preferred embodiment shown in FIG. 1. In an alternate preferred embodiment, line 131 could be connected to a positive voltage source and the common output of the sets of keys such as 121, 132, or 133 are directly connected to terminal 11, 12, . . . 34. Further, the input means other than the keys and the reduction stages shown in FIG. 3 are, in a preferred embodiment, arranged on a single chip using an integrated circuit technique.

Figure 2:
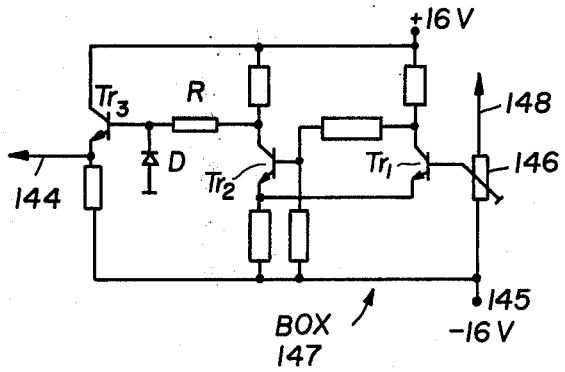
FIG. 2 is a preferred embodiment of the trigger circuit of FIG. 1.

The trigger circuit (147) shown in FIG. 1 is a standard Schmitt circuit shown in FIG. 2. Resistor 146 is shown as a potentiometer to permit level adjustment. Transistors Tr 1 and Tr 2 constitute the trigger circuit, while transistor Tr 3 serves as emitter follower output transistor. Resistor R and diode D clamp the signal at the base of transistor Tr 3 at zero potential thereby supressing all negative outputs on line 144. Prior to activation of any of the keys or, more specifically, of a pair of keys, the voltage at the base of the transistor Tr 1 is sufficiently negative that this transistor is non-conductive. Transistor Tr 2 is conductive, causing the voltage on line 144 to be at ground potential. Upon simultaneous activation of two differently named keys, the voltage at the base of the transistor Tr 1 becomes sufficiently positive to cause transistor Tr 1 to become conductive and transistor Tr 2 to become non-conductive. At this point the voltage at the base of transistor Tr 3 becomes highly positive, causing the voltage on line 144 to be substantially equal to the 16 volt positive voltage at the collector of transistor Tr 3. It is this voltage which, when passing through the differentiating circuit 143 causes all memory flip-flops to be reset. It is further utilized, through the closed contacts of the depressed keys, to set the memory flip-flops associated with the depressed keys following the reset operation.

Referring now to FIG. 3, lines 11–14, 21–24, and 31–34 are the same lines shown at the output of FIG. 1. The signals on these lines are herein referred to as input signals. As shown in FIG. 3, they, respectively, constitute the inputs to reduction stages 1, 2 and 3. The output of reduction stages 1, 2 and 3 is applied to the inputs 41–43, 44–46 and 47–49 respectively of the fourth reduction stage. Reduction stage 4 furnishes 32 different five bit words signifying 31 fundamental tone or fundamental chord signals and a remaining 0- signal in response to predetermined combinations of signals at its input. The 32 5 bit words at the output of reduction stage 4 are listed in Table A, the names of the associated chords being listed opposite to each of these 5 bit words. These fundamental modes and fundamental chords are considered to be musically acceptable for the bass accompaniment system. The relation between the supplied key signals and the final fundamental tone signal or fundamental chord signal is fixed in reduction stage 4.

TABLE A

| Signal word | Name | Signal word | Name |
|---|---|---|---|
| 00000 | — | 10000 | c augmented |
| 00001 | c diminished seventh | 10001 | c sharp augmented |
| 00010 | c sharp diminished seventh | 10010 | d augmented |
| 00011 | d diminished seventh | 10011 | d sharp augmented |
| 00100 | c minor | 10100 | c major |
| 00101 | c sharp minor | 10101 | c sharp major |
| 00110 | d minor | 10110 | d major |
| 00111 | d sharp minor | 10111 | d sharp major |
| 01000 | e minor | 11000 | e major |
| 01001 | f minor | 11001 | f major |
| 01010 | f sharp minor | 11010 | f sharp major |
| 01011 | g minor | 11011 | g major |
| 01100 | g sharp minor | 11100 | g sharp major |
| 01101 | a minor | 11101 | a major |
| 01110 | a sharp minor | 11110 | a sharp major |
| 01111 | b minor | 11111 | b major |

For processing $2^{12} - 1 = 4095$ different key signals and combinations of key signals of one octave to 31 5–bit –words a read-only memory would be required that comprises $5 \times 4095 = 20{,}475$ bits. Carrying out the reduction in two steps requires a substantially smaller memory capacity, viz. no more than $3 \times 3 \times 2^4 + 1 \times 5 \times 2^9 = {}^{2704}$ bits.

FIG. 4 shows an embodiment of reduction stage 1. In this reduction stage the key signals *c*, *c* sharp, *d* and *d* sharp and combinations thereof are processed to become 3–bit–words. Table B gives a list of the results of the process and can be considered as a truth table for reduction stage 1.

TABLE B

| Input signal, or combination of input signals | Signal word |
|---|---|
| — | 000 |
| c | 001 |
| c sharp | 010 |
| d | 011 |
| d sharp | 100 |
| c + d | 101 |
| c + d sharp | 110 |
| c sharp + d sharp | 111 |
| c + c sharp = c | 001 |
| c sharp + d = c sharp | 010 |
| d + d sharp = d | 011 |
| c + c sharp + d = c + d | 101 |
| c + c sharp + d sharp = c + d sharp | 110 |
| c sharp + d + d sharp = c sharp + d sharp | 111 |
| c + d + d sharp = c + d sharp | 110 |
| c + c sharp + d + d sharp = c + d sharp | 110 |

The inputs 11, 12, 13 and 14 of the reduction stage 1 are intended for input signals generated by touching the keys *c*, *c* sharp, *d* and *d* sharp respectively. From table B it appears which signal combinations are eliminated. Hereby both musically unacceptable and apparently unintended key signal combinations effected by an erroneous touch are eliminated simultaneously.

In the reduction stage 1 inverter circuits J1 to J4, AND-gates A1 to A9 and OR-gates 01 to 03 are mutually connected such that, in correspondence to the state of the inputs 11, 12, 13 and 14, each of which has one of two values signals are furnished simultaneously at the outputs of the OR-gates 01, 02 and 03 in accordance with the following logic functions:

11.13 + 13′.14 + 12.14 (via 01),

11.14 + 11′.12 + 11′.13 (via 02) and 11.14′ + 11′.14 + 12′13.14′ (via 03), respectively.

In the same manner the signals at the outputs of reduction stages 2 and 3 respectively are applied to the inputs 44 to 46 and 47 to 49 of the reduction stage 4, said signals being dependent on the binary input signals supplied at inputs 21 to 24 and 31 to 34 respectively.

Reduction stage 4, in a preferred embodiment of the present invention is embodied in a diode matrix or a read only memory. As stated above, the inputs to the matrix are received on terminals 41–49. The resulting outputs, each generated in response to a particular combination of input signals, are the signal words listed in Table A.

A preferred embodiment of stage 4 is shown in FIG. 4*a*. More specifically, the interconnections between inputs 41–49 and output 51 are fully represented, while the connections to the remaining outputs are omitted for the sake of clarity. As shown in FIG. 4*a*, each of the inputs 41–49 is connected to one or more of a plurality of NOR-gates 510–541 both directly and through respective inverters 501–509. The outputs of NOR-gates 510–541 are connected to the horizontal conductors of a matrix 545. Diode connections (shown as dots in FIG. 4*a*) interconnect selected vertical conductors of matrix 545 to each of the horizontal conductors. The so-connected vertical conductors then form the inputs of a NOR-gate 546. The output of NOR-gate 546 constitutes output 51 of reduction stage 4. One bit of the five bit words furnished by reduction stage 4 thus appears at output 51 for each possible combination of signals at inputs 41–49. The remaining four bits are similarly generated at outputs 52–55.

The five-bit words furnished by reduction stage 4 are applied to the inputs 51–55 of tone control means 5 which, in a preferred embodiment of the present invention, are embodied in a read-only memory which is shown in greater detail in FIG. 5. Tone control means 5 has further inputs 56, 57 and 58 which are connected to the outputs of a bass program selecting means 7. The bass program selecting means is shown in FIG. 6. They have inputs 71 and 72 for bass program selection and inputs 74, 75 and 76 connected to the outputs of a counter 6. The counting input of counter 6 is connected through a line 61 to the rhythm or clock pulse generator 61′. Counter 6 is a modulo 8 counter, so that each selected bass program is played in four-quarter time, one complete forward counting operation of the counter covering two such periods. If it is desired that the selected bass program be played in ¾ time, the modulo 8 counter can be changed externally into a modulo 6 counter. This is accomplished via an input 62 by means of an adjustable reset means 64. The inputs of stage 64 are connected to outputs 74, 75 and 76 of the counter. Stage 64 has an output labeled 63. Counter 6 is reset after a count of 6 by the signal on line 63 when it is desired to change the counter to a modulo 6 counter. As a modulo 8 counter the count is of course reset after a count of 8. Further shown in FIG. 3 is a start switch which, when closed, applies a positive voltage to a differentiating circuit which furnishes a reset signal through a line 62 to counter 6, resetting its three stages 65, 66, and 67 to zero. The reset signal is also applied to clock pulse generator 61′.

The bass program selecting means are well known in the art, but for convenience, are shown in FIG. 6. Inputs 74, 75 and 76 of course energized in predetermined combinations in a predetermined order in accordance with the count of counter 6 which is a binary counter. There signals on inputs 74, 75 and 76 are combined with program selection signals applied under control of the player of the instrument at inputs 71, and/or 72, or if desired, further inputs such as input 73 shown in FIG. 3 but not shown in FIG. 6. Specifically, the signals at all five inputs and the inverse of signals 71, 72 and 76 as supplied by inverters 71', 72' and 76' respectively are applied in various combination to the inputs of NOR-gates 201, 202 . . . 208. The outputs of NOR-gates 201 . . . 208 are connected to the horizontal conductors of a matrix 214, as are inputs 74 and 75, each directly ad through an inverter 74' and 75' respectively. The 12 horizontal conductors of matrix 214 are connected in a selected pattern to its vertical conductors by means of diodes (indicated as dots in FIG. 6). The vertical conductors are arranged in three sets of four conductors each, each set forming the inputs of a NOR-gate labeled 211, 212, 213 respectively. The outputs of NOR-gates 211, 212, and 213 are connected to terminals 56, 57 and 58 respectively, It is seen that the circuitry of FIG. 6 causes the count furnished by counter 6 on terminal 74, 75 and 76 to be applied in accordance with a selected bass program, that is in accordance with a selected bass-tone sequence to lines 56, 57 and 58 which form an input to the tone control means. The signals at inputs 56, 57 and 58 thus determine, in relation to a certain fundamental tone or fundamental chord, which tone will be generated in the bass accompaniment at a given moment in the rhythm. The fundamental tone or fundamental chord is of course signified by the signal which appears as a five-bit word at inputs 51 to 55. As an example, if inputs 51–55 select the chord *f* minor, the signal 01001 will appear at terminals 51–55 (see Table A). A particular bass program in *f* minor comprises the tones *f, a* flat, *c, d, e* flat. The bass program will require a particular sequence of play of these tones, which sequence is controlled by the three-bit words applied at inputs 56–58. The so-controlled output of tone control means 5 appears on five output lines. Two of the output lines are connected to inputs 81 and 82 of a decoder 8, the third is connected to input 83 of decoder 8 and also to a line 102. The remaining two outputs of tone control means 5 are connected to lines 103 and 104.

The exact implementation of tone control means 5 will of course depend upon the desired bass programs. While its implementation would present no difficulty to one skilled in the art, an example is shown in FIG. 5. Specifically, only that portion of tone control means 5 which leads to output line 104 is shown. The remaining outputs to lines 81, 82, 83/102 and 103 are omitted for the sake of clarity. As shown in FIG. 5, the inputs from lines 51, 52, 53 and 54 are connected both directly and through inverters 601, 602, 603 and 604 respectively to selected inputs of NOR-gates 612, 613, 614 . . . 627. The outputs of the NOR-gates are connected to vertical conductors of a matrix 628 and, in accordance with a determined pattern, the vertical conductors are connected to horizontal conductors by diodes indicated as circles in FIG. 5. Further vertical conductors of matrix 628 are connected to receive the signals at inputs 55, 56, 57 and 58 both directly and after inversion by inverters 605, 609 and 610, and 611 respectively. The direct inputs of these signals at terminals 56, 57 and 58 are applied by reinverting the outputs of inverters 609, 610 and 611 in inverters 606, 607 and 608 respectively. The vertical conductors connected directly or indirectly to inputs 55, 56, 57 and 58 are of course also connected through appropriate diodes to horizontal conductors of matrix 628. The output on line 104, and of course similarly on the remaining output lines of tone control means 5, is a function of both the timing or rhythm signals applied on inputs 56, 57 and 58 and the selected chord or fundamental tone signal applied at input 51–55.

The information generated in tone control means 5 in the form of a five-bit word as to the tone to be played is, as mentioned above, transmitted to the inputs 81, 82 and 83 of a 3 to 6 decoder 8, by which a bass tone switch 9 is controlled. Three to six decoder 8 is a well known circuit, which for convenience, is shown in FIG. 7. As shown in FIG. 7, inputs 81, 82 and 83 are connected both directly and through inverters 801, 802 and 803, respectively, to the inputs of six NOR-gates 804–809. The NOR-gate outputs constitute the outputs of decoder 8, that is the outputs of NOR-gates 804, 805, 806, 807, 808 and 809 are designated 971, 972, 973, 974, 975, and 976 respectively. Since the inputs of NOR-gate 804 are connected to the outputs of inverters 801, 802 and 803, NOR-gate 804 and line 971 will carry a 1 signal only in the simultaneous presence of signals at terminals 81, 82 and 83. The input conditions which result in outputs at terminals 972–976 can of course be similarly determined. The 3 bit portion of the 5 bit word at the output of tone control means 5 is thus converted by a decoder 8 into six gate control signals each applied at one of the six inputs 971 to 976 of bass tone switch 9. Bass tone switch 9 further has six inputs, 91–96, which are connected to tone sources (oscillators) which are mutually tuned according to a whole tone scale and, for example, generate successively, a C, D, E, F sharp, G sharp, and A sharp. The bass tone switch contains six AND-gates 911, 921, 931, 941, 951 and 961. Each AND-gate has a first input connected to one of the inputs from the oscillators and a second input connected to receive one of the gate control or enable signals. Thus, AND-gate 911 has a first input connected to terminal 91 and a second input connected to line 971, AND-gate 921 has a first input connected to line 92 and a second input to line 972, etc. Thus a gate enable signal at input 971 causes the tone signal at input 971 to be transmitted to a bass tone output 101. Output 101 also constitutes the signal input of a frequency divider stage 10. It might be noted at this point that tone control means 5, decoder 8, bass tone switch 9 and frequency divider stage 10 as well as the sound reproduction system connected to the output of the frequency divider stage 10 are herein referred to as output means.

Referring again to frequency divider stage 10 of FIG. 3, it will be noted that it has the above-mentioned input 101 from the base tone switch and, further, 3 control inputs respectively connected to lines 102, 103 and 104. These lines furnish another portion of the 5-bit word formed at the output of tone control means 5. The state of the input on lines 102, 103 and 104 determines whether the frequency of the tone received at input 101 is divided by a factor of 4, 8, 6 or 12. Specifically, frequency divider stage 10 comprises frequency divider circuits 1001, 1002, 1003 and 1004 as well as identical switching-through means 1021, 1031 and 1041. Stages 1021, 1031 and 1041 are controlled by the inputs on lines 102, 103 and 104, respectively. frequency divider stages 1002 and 1004 each cause a frequency division by 2 while frequency divider stage 1001 divides the frequency by 3 and frequency divider stage 1003 divides the frequency by a factor of 4. To illustrate the operation of the switching through means 1021, it should be noted that, for any given audio tone signal at terminal 101, a square wave signal of ⅓ the frequency will appear at the output of stage 1001. Further, the signal will be further frequency divided by stage 1002 so that a signal of frequency $f/6$, where $f$ is the frequency of the signal at terminal 101, will appear at the output of stage 1002. It is the function of switching-through means 1021 to select either the signal at the output of stage 1001 or the signal at the output of stage 1002 for transmission to the next switching through means 1031. This selection takes place in accordance with the signal on line 102. If the signal on line 102 is high, signifying a logic 1, then a 1 signal is constantly impressed on the first input of NAND-Gate N1 while a 0 signal is impressed on the first input of NAND-Gate N2. Since a NAND-Gate furnishes a 0 output only in the presence of two 1 signals at its inputs, the signal at the output of the NAND-Gate N1 will be a 1 signal when the signal at the output of stage 1001 is 0 and will be a 0 signal when the signal at the output of stage 1001 is a 1. However, the signal at the output of NAND-Gate N2, which has a 0 impressed on its first input, will be 1 regardless of the state of the signal at the output of stage 1002. It is thus seen that, when a high signal is present on line 102, the signal transferred to switching-though stage 1031 will be the signal at the output stage 1001, that is a signal having undergone a frequency division by a factor of 3.

Switching-through stage 1031 then selects between the signal at the output of switching-through stage 1021 and the signal at the output of frequency divider 1003 on the basis of the signal on line 103. Stage 1041 then serves to decide whether the signal at the output of unit 1031 is to be divided by 2 or not, in accordance with the signal on line 104.

In Table C an explanation is given of the tone formation in the bass tone switch 9 and frequency divider stage 10 with respect to the tones A sharp and D sharp.

Table C

| Tone | State of the inputs 104 | 103 | 102 | 83 | 82 | 81 |
|---|---|---|---|---|---|---|
| $(A\ sharp)_2$ = A sharp/4 | 1 | 0 | 0 | 1 | 0 | |
| $(A\ sharp)_1$ = A sharp/8 | 0 | 0 | 0 | 1 | 0 | |
| $(D\ sharp)_2$ = A sharp/6 | 1 | 1 | 0 | 1 | 0 | |
| $(D\ sharp)_1$ = A sharp/12 | 0 | 1 | 0 | 1 | 0 | |

The result is that at output 110 of a frequency divider stage 10, all tone signals in the range of two octaves can be furnished in a kind of natural tuning. As bass tones are referred to here, the deviation from equally tempered tuning is too small to be perceived.

It is seen that the arrangement according to the present invention of an electronic musical instrument provides a rhythmically modulated bass accompaniment based on 32 fundamental chords or tones generated in response to the activation of various keys or key combinations of the manuals of the instrument.

I claim:

1. In an electronic musical instrument having bass program generator means for furnishing a rhythmic bass program: an accompaniment system, comprising, in combination, a plurality of input means for furnishing a plurality of input signals each in response to activation of a corresponding one or a corresponding combination of said input means; reduction circuit means connected to said input means for furnishing one of a plurality of predetermined tone or chord signals in response to each of said input signals, said plurality of predetermined tone or chord signals being substantially less in number than said plurality of input signals, said reduction circuit means having five outputs, said chord signals comprising 32 5 bit words; and output means connected to said reduction circuit means and said bass program generator means and including a sound reproduction system for furnishing a sound output in response to said tone or chord signals and under control of said bass program generator means.

2. In an electronic musical instrument having bass program generator means for furnishing a rhythmic bass program: an accompaniment system, comprising, in combination a plurality of input means for selectively furnishing one or a plurality of input signals in response to activation of a respective one or a combination of said input means, said input means comprising an accompaniment manual of an electronic organ, having 12 keys, input circuit means responsive to activation of said keys for furnishing corresponding ones of said input signals, a plurality of memory means connected to said input circuit means, each for storing a corresponding one of said input signals until receipt of a reset signal, and means for furnishing said reset signal upon depression of a subsequent one of said keys; reduction circuit means connected to said input means for furnishing one of a plurality of predetermined tone or chord signals in response to each so-furnished input signal or plurality of input signals, said plurality of predetermined tone or chord signals being substantially less in number than said plurality of input signals; and output means connected to said reduction circuit means and said bass program generator means and including a sound reproduction system, for furnishing a sound output in response to said tone or chord signals and under control of said base program generator means.

3. In an electronic musical instrument having bass program generator means for furnishing a rhythmic bass program: an accompaniment system, comprising, in combination, a plurality of input means for selectively furnishing one or a plurality of input signals in response to activation of a respective one or a combination of said input means; reduction circuit means connected to said input means for furnishing one of a plurality of predetermined tone or chord signals in response to each so-furnished input signal or plurality of input signals, said reduction circuit means having less outputs than inputs; and output means connected to said reduction circuit means and said bass program generator means and including a sound reproduction system, for furnishing a sound output in response to said tone or chord signals and under control of said bass program generator means.

4. An electronic musical instrument as set forth in claim 3, wherein said input means further comprise a plurality of memory means connected to said input circuit means, each for storing a corresponding one of said input signals until receipt of a reset signal; and means for furnishing said reset signal upon depression of a subsequent one of said keys.

5. An electronic musical instrument as set forth in claim 4, wherein said input circuit means comprise voltage furnishing means, each for applying a voltage to a corresponding one of said memory means upon depression of one of said keys; and wherein said means for furnishing a reset signal comprise a differentiating circuit connected between said voltage furnishing means and said memory means.

6. An electronic instrument as set forth in claim 5, wherein said bass program generator means comprise bass program selecting means for selecting one of a plurality of bass programs stored therein under external control, and rhythm generator means connected to said bass program selecting means for timing the so-selected bass program; and wherein said input means further comprise an AND-gate connected to said voltage furnishing means, said rhythm generator means and said memory means, for furnishing said reset signals to said memory means upon simultaneous receipt of said voltage and a signal from said rhythm generator means.

7. An electronic musical instrument as set forth in claim 4, wherein said accompaniment manual has more than 12 keys belonging to more than one octave; and further comprising means for connecting corresponding keys in each of said octaves in parallel to said input circuit means.

8. An electronic musical instrument as set forth in claim 4, wherein said input means further comprises a melody manual having at least 12 keys; wherein said input circuit means further comprise a means for furnishing said input signals only upon simultaneous depression of more than one of said keys of said melody manual.

9. An electronic musical instrument as set forth in claim 8, wherein said melody manual has more than 12 keys belonging to more than one octave; and further comprising means for connecting corresponding keys in each of said octaves in parallel to said input circuit means.

10. An electronic musical instrument as set forth in claim 3, wherein said reduction circuit means comprise a first, second and third reduction stage each having a plurality of inputs connected to said input means and plurality of outputs for furnishing respectively, first, second and third reduction stage output signals in response to said input signals, and a fourth reduction stage connected to said outputs of said first, second and third reduction stages, for furnishing said chord signals in response to said first, second and third reduction stage output signals.

11. An electronic musical instrument as set forth in claim 10, wherein said first, second and third reduction stages each have four inputs and three outputs.

12. An electronic musical instrument as set forth in claim 3, wherein said reduction circuit means has five outputs; and wherein said chord signals comprise 32 5 bit words.

13. An electronic musical instrument as set forth in claim 12, wherein said 32 5 bit words signify 12 major chords, 12 minor chords, four augmented triads, three diminished chords of the seventh, and a 0 signal.

14. An electronic musical instrument as set forth in claim 3, wherein said bass program generator means comprises bass program selecting means having a first set of inputs for receiving timing signals, a second set of inputs for external bass program selection, and a set of outputs connected to said output means for rhythmic selection of bass tones signified by said chord signal, and rhythm generator means having an output connected to said first set of inputs for furnishing said timing signals to said bass program selecting means.

15. An electronic musical instrument as set forth in claim 14, wherein said rhythm generator means comprise clock pulse generator means for furnishing clock pulses, and counting means connected to said clock pulse generator means for counting said clock pulses and furnishing corresponding binary counting signals constituting said timing signals to said bass program selecting means.

16. An electronic musical instrument as set forth in claim 14, wherein said output means comprise tone control means having a first set of inputs for receiving said chord signals, a second set of inputs connected to the outputs of said bass program generator means and tone control outputs for rhythmically furnishing bass tone control signals in response to signals at said first and second sets of inputs.

17. An electronic musical instrument as set forth in claim 16, wherein said output means further comprise decoder means having decoder inputs connected to selected ones of said outputs of said tone control means, for furnishing audio tone control signals in response to signals at said decoder inputs, a plurality of audio oscillators each for furnishing a corresponding audio tone signal, and bass tone switch means connected to said decoder means and said plurality of audio oscillators, and having a bass tone output, for selectively furnishing said audio tone signals to said bass tone output under control of said audio tone control signals.

18. An electronic musical instrument as set forth in claim 17, wherein said output means further comprise frequency divider means having a signal input connected to said bass tone output and at least one frequency control input connected to a corresponding one of the outputs of said tone control means, for frequency dividing the signal at said bass tone output under control of said tone control means and for furnishing a corresponding final output signal, and means for connecting the output of said frequency divider means to said input of said reproduction system.

19. An electronic musical instrument as set forth in claim 18, wherein said plurality of audio oscillators comprise six audio oscillators tuned in accordance with a whole note scale.

20. An electronic musical instrument as set forth in claim 3, wherein said input circuit means, reduction circuit means, bass program generator means and output means are arranged on a single chip using an integrated circuit technique.

* * * * *

UNITED STATES PATENT OFFICE
CERTIFICATE OF CORRECTION

PATENT NO. : 4,018,122

DATED : Apr. 19, 1977

INVENTOR(S) : Tijmen van der Kooij

It is certified that error appears in the above-identified patent and that said Letters Patent are hereby corrected as shown below:

In the heading, after item [21] insert:--

[30] Foreign Application Priority Data

Feb. 21, 1973 Netherlands ..... 73 02404
Sep. 24, 1973 Netherlands ..... 73 13110

Signed and Sealed this

Twenty-eighth Day of June 1977

[SEAL]

*Attest:*

RUTH C. MASON
*Attesting Officer*

C. MARSHALL DANN
*Commissioner of Patents and Trademarks*